US007469969B2

(12) United States Patent
Wiecek

(10) Patent No.: US 7,469,969 B2
(45) Date of Patent: Dec. 30, 2008

(54) RECLINER CHAIR SHIELDING ASSEMBLY

(75) Inventor: Glenn N. Wiecek, Shelbyville, KY (US)

(73) Assignee: L&P Property Management Company, South Gate, CA (US)

( * ) Notice: Subject to any disclaimer, the term of this patent is extended or adjusted under 35 U.S.C. 154(b) by 0 days.

(21) Appl. No.: 11/747,003

(22) Filed: May 10, 2007

(65) Prior Publication Data

US 2008/0277988 A1 Nov. 13, 2008

(51) Int. Cl.
*A47C 31/00* (2006.01)

(52) U.S. Cl. ..... 297/463.1; 297/463.2

(58) Field of Classification Search ..... 297/69, 297/85, 463.1, 463.2; 16/324, 325
See application file for complete search history.

(56) References Cited

U.S. PATENT DOCUMENTS 3,096,121 A * 7/1963 Knabusch et al. ..... 297/269.1
3,099,487 A * 7/1963 Knabusch et al. ..... 297/423.19
3,781,060 A * 12/1973 Pentzien ..... 297/68
4,113,305 A * 9/1978 Hampton ..... 297/69
4,595,233 A * 6/1986 Fox ..... 297/69
5,088,789 A * 2/1992 LaPointe et al. ..... 297/69
6,722,736 B2 * 4/2004 Guillot ..... 297/330
2004/0195798 A1 * 10/2004 Newfer et al. ..... 280/250.1

* cited by examiner

*Primary Examiner*—David R Dunn
*Assistant Examiner*—Patrick D Lynch
(74) *Attorney, Agent, or Firm*—Shook, Hardy & Bacon LLP

(57) ABSTRACT

This invention is related to a shielding assembly comprising a cover plate, upper and lower paddle arms, a circular plate, and a back plate for covering an opening in an arm of a recliner chair. The opening provides clearance for a drive tube that moves independently from the arm. The paddle arms are rotatably coupled to the cover plate, wherein rotation is restrained by tension devices. The circular plate is slidably disposed between the paddle arms and the back plate. The back plate is fixedly attached to the cover plate by fasteners that limit rotation of the paddle arms. In operation, if the drive tube moves upward or downward, the circular plate, having a bore circumferentially engaged to the drive shaft, moves therewith vacating a portion of the opening. One of the paddle arms may be deflected by the drive tube movement while another continues to overlie the vacated portion.

20 Claims, 6 Drawing Sheets

RECLINER CHAIR SHIELDING ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

This invention relates to a shielding assembly in an arm of a recliner chair, and more particularly, to a plurality of plates that provide coverage of an opening in the arm during adjustment to each position of the recliner chair.

Recliner chairs are common in the furniture industry. Typically, recliner chairs are chairs having a base with arms fixed thereto, a recliner mechanism, extendable footrests, and adjustable seatbacks that allow a user to recline in several positions. One type of recliner chair is a sleep over recliner chair that typically has four positions in use: a closed, stowed position; an open, reclining position; a fully-reclined position; and a Trendelenberg position. These positions are achieved when the user activates a release lever that is attached to the recliner mechanism within the recliner chair. The connection between the recliner mechanism and the release lever is made by a drive tube, which extends through one arm of the recliner chair so that the release lever is accessible to the user.

During operation, the drive tube may move as the recliner mechanism moves through the various positions mentioned above. However, this drive tube movement is separate from the arm, which is typically a stationary component of the recliner chair. Accordingly, an opening in the arm is required to provide clearance for this drive tube movement. For particular reclining chairs (e.g., sleep over recliner chairs with independently functioning recliner and footrest mechanisms that provide the user multiple options for movement between seating, reclining, and sleeping positions as disclosed in U.S. patent application Ser. No. 11/412,679, filed Apr. 27, 2006, entitled SLEEP OVER RECLINER CHAIR) the range of movement of the drive arm is quite large. Consequently, a large opening in the arm is necessary to prevent any interference with the drive tube.

The present invention pertains to a shielding assembly that resides within the arm of the recliner chair, and that covers the opening of the arm. Significantly, the design of the shielding assembly relates to a drive tube having a large range of movement, and that accommodates internal boundaries within the arm of the recliner chair. Further, the present invention provides a plurality of moving plates to attain coverage of the opening in the arm without restricting movement of the drive arm.

BRIEF SUMMARY OF THE INVENTION

Accordingly, the present invention provides a shield assembly for a recliner chair. The recliner chair includes a recliner mechanism pivotably coupled to a drive tube that extends through an opening in an arm that is attached to a base. The movement of the drive tube is independent from the arm; as such, the opening in the arm is typically large in order to provide clearance for drive tube movement. The shield assembly is coupled to the arm and provides coverage for the opening in the arm. Further, the shield assembly provides a circular bore such that the drive tube may pass through the arm, and may move in an unrestrained manner. A brief overview of the shield assembly and its components follows immediately below. A more detailed description is provided in the Detail Description of the Invention section.

In general, the shield assembly includes a cover plate, paddle arms, a circular plate, and a back plate. The cover plate has an aperture, and mounting holes used to connect the cover plate to the chair arm. The aperture is sized to provide clearance for an entire range of movement of a drive tube of a recliner mechanism. The paddle arms, typically a lower paddle arm and an upper paddle arm, are each rotatably coupled to cover plate, wherein rotation is restrained by a tension device attached to each paddle arm. The circular plate is slidably disposed between the paddle arms and the back plate, and includes a circular bore. The drive tube extends through the bore of the circular plate. The back plate is fixedly attached to the cover plate and has an generally matching the profile of the aperture in the cover plate. The fasteners are used for fixedly attaching the back plate also serve to limit the movement of the circular plate, and to limit rotation of the paddle arms.

In operation, the drive tube moves to positions that correspond with recliner positions of the recliner mechanism. Initially, as the drive tube moves, the circular plate, which is circumferentially engaged to the drive tube, covers part of the external and internal apertures. If the drive tube moves to an upward or downward position, the circular plate may no longer substantially overly the entirety of the apertures. But the paddle arms act in conjunction with the circular plate so that the apertures are covered in all positions of the drive tube. As such, the combination of the circular plate and the paddle arms provides substantial coverage of the apertures, and covers the opening in the arm of the recliner chair throughout the range of positions of the drive tube.

As will be seen from the detailed description that follows, the invention provides a shielding assembly that covers an opening in the arm of the recliner chair for the entire range of movement of the drive arm. Additional advantages, and novel features of the invention will be set forth in part in a description which follows, and in part will become apparent to those skilled in the art upon examination of the following, or may be learned by practice of the invention.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views.

DETAILED DESCRIPTION OF THE INVENTION

Figure 1:
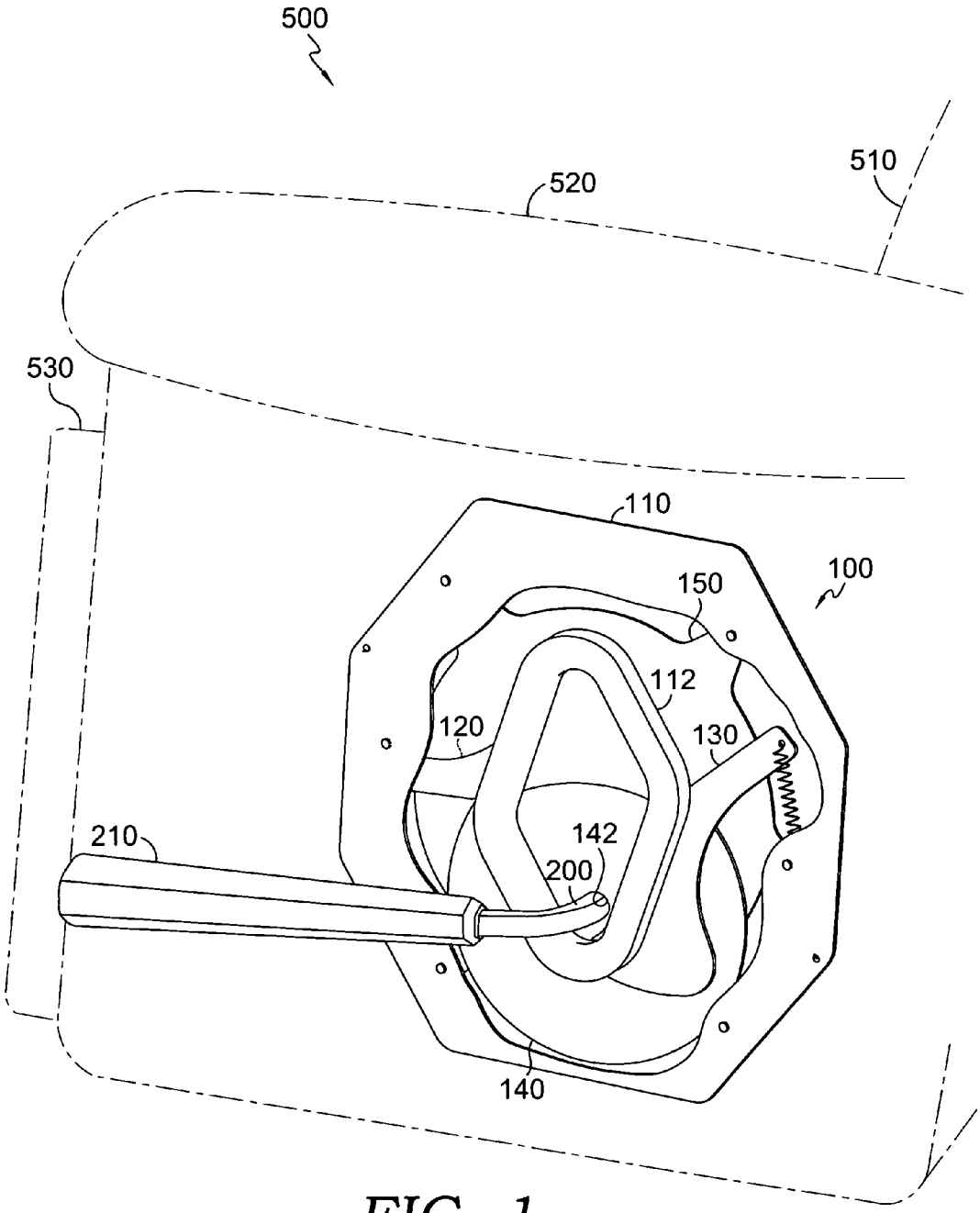
FIG. 1 is a diagrammatic exterior perspective view of a shield assembly, positioned according to an embodiment of the present invention with a portion cut away.

Referring to the drawings in greater detail and initially to FIG. 1, a shield assembly is shown and designated generally by reference numeral 100. Initially, the shield assembly 100 is shown assembled to an exemplary recliner chair 500 (illustrated as a ghost view) that has a seat back 510, at least one arm 520, an extendable ottoman 530. It should be understood that the location and orientation of attachment of the shield assembly 100 and the illustrated configuration of the exemplary recliner chair 500 are for demonstrative purposes and should not construed as limiting. Generally, the shield assembly 100 includes a cover plate 110, an upper paddle arm 120, a lower paddle arm 130, a circular plate 140, and a back plate 150. Typically, the shield assembly 100 is mounted over an opening in an arm of a reclining chair (not shown). As used herein, "reclining chair" is not meant to be limiting and may comprise sofas, seating units, and other such furniture that includes a recliner mechanism, a base, and at least one arm, as should be understood and appreciated by persons familiar with the field of the invention. The recliner mechanism is typically moveable into different recliner positions. In one embodiment, the recliner positions correspond with movement of the recliner mechanism of a sleep over recliner chair and include the following: a closed, stowed position; an open, reclining position; a fully-reclined position; and a Trendelenberg position (i.e., the user is in a supine position—lying down face up—on a surface inclined 45 degrees, head at the lower end and legs flexed over the upper end). In other embodiments, the recliner positions correspond to other recliner mechanism configurations or combinations of the recliner positions discussed previously.

In an exemplary embodiment, the recliner mechanism includes a drive tube, as depicted by reference numeral 200. It should be understood that the designation of reference numeral 200 as "drive tube" is not meant to be limiting, wherein the drive tube 200 may be formed of a solid metal rod, square/hexagonal bar, or any other suitable material known to those of ordinary skill in the furniture manufacturing industry. Drive tube 200 is pivotably coupled to the recliner mechanism, and is used to move the recliner mechanism into various positions discussed above. As the mechanism is placed in different positions, the drive tube moves with respect to the chair arm from which it is protruding. The arm is attached to the base of the recliner chair, and held in a stationary position. As such, the drive tube movement is independent from the arm. Consequently, the opening in the arm is sized to provide clearance for the independent movement of the drive tube 200 that extends therethrough, as more fully discussed below with reference to FIG. 6.

In another embodiment, with continued reference to FIG. 1, the drive tube 200 is shown with a release lever 210. Release lever 210 may be an operational control adapted to adjust or activate the recliner mechanism between multiple recliner positions. In particular, rotation of the release lever 210 serves to move the recliner mechanism between a footrest closed position and footrest open position, as discussed below with reference to FIG. 6. Although a single configuration of the release lever 210 has been shown, it should be understood and appreciated by those of ordinary skill in the art that other release mechanisms could be used, and that the invention is not limited to the configuration shown and described.

Figure 2:
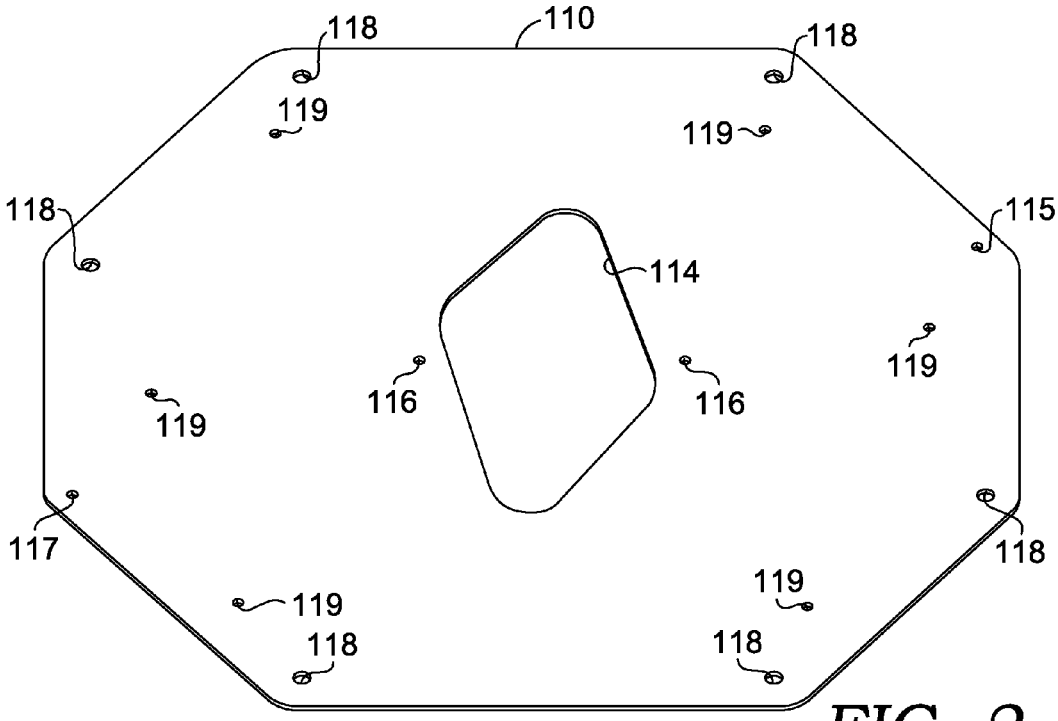
FIG. 2 is an interior perspective view of a cover plate, in accordance with an embodiment of the present invention.

Referring now to FIG. 2, the cover plate 110 is shown, in accordance with an embodiment of the present invention. Typically the cover plate 110 is formed of sturdy material, such as stamped formed steel. It should be understood that any other suitable materials could also be used, e.g., plastic or synthetic material. The cover plate 110 includes an external aperture 114, attachment holes 115,117 for attaching a tension device (discussed below), at least one pivot hole 116, a plurality of connecting apertures 119, and a plurality of mounting holes 118. The at least one pivot hole 116 is configured to rotatably couple the paddle arms 120,130 (discussed below) to the cover plate 110. The plurality of connecting apertures 119 are configured to receive fasteners for fixedly attaching the back plate 140 to the cover plate 110. External aperture 114 may be formed by stamping, cutting, or any other suitable fabrication processes. In one embodiment, the external aperture 114 is centrally located within the cover plate 110 and is shaped to provide clearance for the entire range of positions of the drive tube 200. By way of example, the external aperture 114 may have an aperture profile that is generally diamond-shaped. In another embodiment, a trim ring 112 (FIG. 1) is provided and coupled to the aperture profile to provide a more aesthetic appearance. The trim ring 112 may be form of molded plastic or any other suitable material, and may be coupled by adhesion, snap-fit, or other methods of coupling understood by those of ordinary skill in the art.

The plurality of mounting holes 118 are formed in the cover plate 110 to receive fasteners so that the shielding assembling 100 may be attached to the arm of the recliner mechanism. Typically, the mounting holes 118 are spaced such that they are located outside a perimeter of the opening in the arm. Attachment may be made by fasteners (not shown) such as hex-bolts, hex-nuts, or any other suitable fasteners which are well known in the furniture manufacturing industry. In one embodiment, the cover plate 110 is attached internally to the arm such that the trim ring 112 (FIG. 1) is directed outward.

Figure 3:
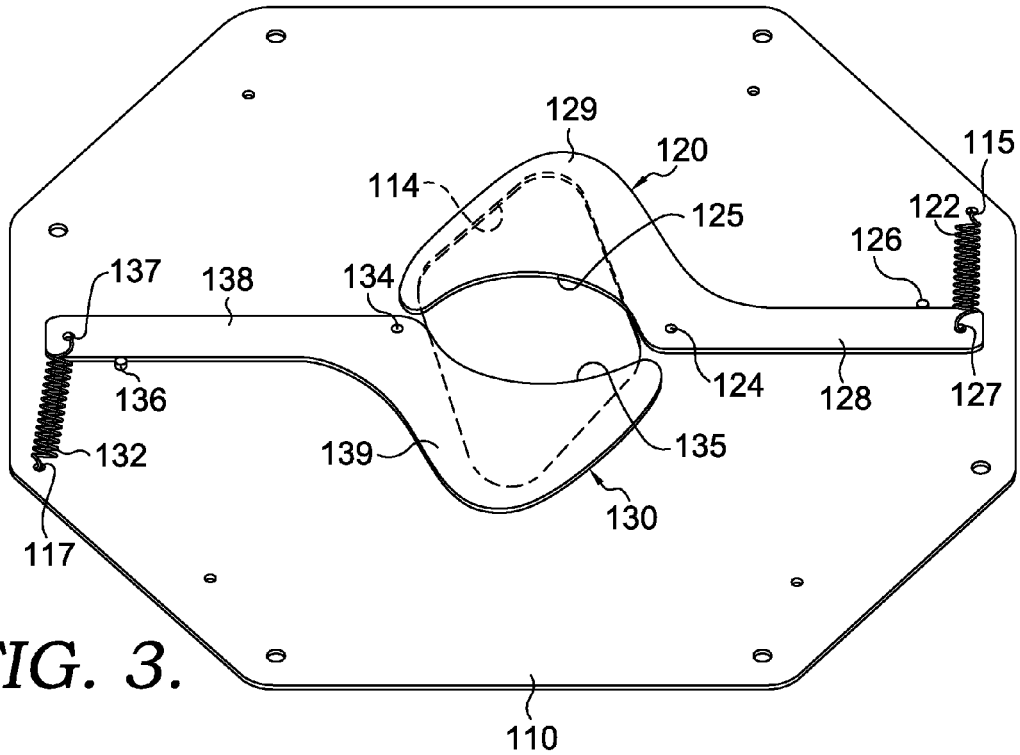
FIG. 3 is a view similar to FIG. 2, but with paddle arms and tension devices assembled thereto, in accordance with an embodiment of the present invention.

Referring now to FIG. 3, the upper and lower paddle arms 120,130 will be discussed. Upper and lower paddle arms 120,130 are typically formed of sturdy material, such as stamped formed steel. It should be understood that any other suitable materials could also be used. Each of the upper and lower paddle arms 120,130 include a lever portion 128,138, a coverage portion 129,139, and a pivot 124,134, respectively. Lever portions 128,138 include attachment holes 127,137 for attaching tension devices 122,132 respectively. Integral with the tension devices 122,132 are coupling configurations disposed at either end; however, any method of coupling the tension devices 122,132 that is known in the art is also contemplated by the present invention. As such, the tension device 122 is interconnected between the attachment hole 115 and the attachment hole 127 thereby biasing the coverage portion 129 of the upper paddle arm 120 downward. Similarly, the tension device 132 is interconnected between the attachment hole 117 and the attachment hole 137 thereby biasing the coverage portion 139 of the lower paddle arm 130 upward. Persons familiar with the field of the invention will realize that the tension devices 122,132 may be practiced by various devices which are different from the specific illustrated embodiment (e.g., tension spring, biasing mechanism, air cylinder) and may be interconnected between the paddle arms 120,130 and another component; accordingly, it is emphasized that the invention is not limited only to the embodiments depicted.

The upper and lower paddle arms 120,130 are rotatably coupled to the cover plate 110 by the pivots 124,134, respectively. The pivots 124,134 may be made by a pin or rivet that is assembled to the pivot holes 116. However, it should be understood and appreciated by one of ordinary skill in the art that any suitable rotatable coupling method could be used. The separate pivots 124,134 allow the upper paddle arm 120 and the lower paddle arm 130 to rotate independently of each other. During rotation of the upper and lower paddle arms 120,130, the respective coverage portions 129,139 are able to traverse the external aperture 114 providing varying degrees of coverage.

Not only is the independent rotation of the upper and lower paddle arms 120,130 about pivots 124,134, respectively, restrained by the tension devices 122, 132; rotation is limited by pins 126,136. Pin 126 is assembled to one of the connecting apertures 119, while pin 136 is assembled to another of the connecting apertures 119 of cover plate 110. Pins 126,136 provide an obstruction to the rotation of the upper and lower paddle arms 120,130, respectively, so as to prevent the paddle arms from interfering with one another. Further, pins 126,136 may assist in fixedly attaching the back plate 150 to the cover plate 110 (discussed below). It should be understood that pins 126,136 are but one embodiment of a fastener or device for obstructing the free rotation of the upper and lower paddle arms 120,130 and that other methods exist (e.g., weld spot, formed impression). These methods are also contemplated by the present invention.

As can been seen in FIG. 3, the tension device 122 biases the lever portion 128 of the upper paddle arm 120 upward, holding it against the pin 126. Similarly, the tension device 132 biases the lever portion 138 of the lower paddle arm 130 downward, holding it against pin 136. In one embodiment, when the upper and lower paddle arms 120,130 are resting in contact with pins 126,136, respectively, the lever portions 128,138 are generally mutually laterally aligned. In this orientation, the coverage portions 129,139 of the upper and lower paddle arms 120,130, respectively, provide the greatest coverage of the external aperture 114. That is, the greatest area of either the upper or lower paddle arms 120,130 that can overlie the external aperture 114, based on the rotational limits of pins 126,136, will overlie the external aperture 114 in this instance. This position of each of the upper paddle arm 120 and lower paddle arm 130, is hereinafter referred to as the coverage position.

With continued reference to FIG. 3, the coverage portions 129,139 of the upper and lower paddle arms 120,130 are manipulated by the drive tube 200 (see FIG. 1 hereinafter for a depiction of the drive tube 200). In particular, the coverage portions 129,139 each have an arcuate communication edge 125,135, respectively, that may be contacted by the outside circumference of the drive tube 200. As such, movement by the drive tube 200 is operative to effect rotation of either of the upper or lower paddle arms 120,130 individually, if the force exerted by the drive arm 200 overcomes a biasing force of either of the tension devices 122,132. Typically, the any movement by the drive tube 200 that contacts one of the arcuate communication edges 125,135 will overcome the biasing force and cause rotation of the upper and lower paddle arms 120,130 respectively. This rotated orientation of either the upper paddle arm 120 or the lower paddle arm 130, although the exact angle of rotation may vary, is hereinafter referred to as the deflected position.

Figure 4:
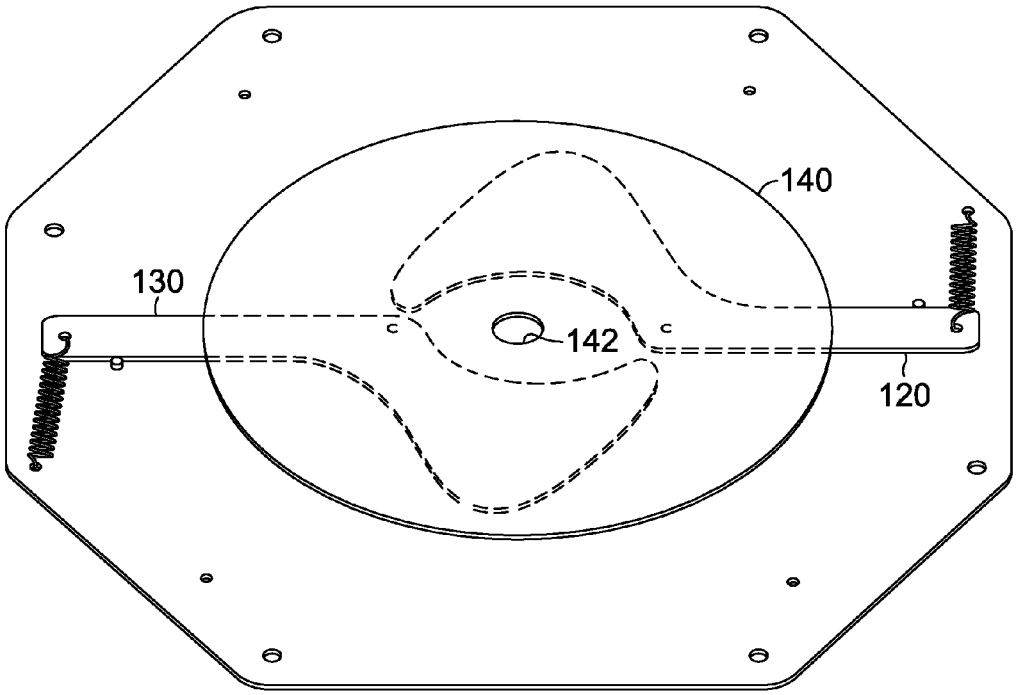
FIG. 4 is view similar to FIG. 3, but with a circular plate assembled thereto, in accordance with an embodiment of the present invention.

Turning now to FIG. 4, the circular plate 140 will now be described. Circular plate 140 is typically formed of sturdy material, such as stamped formed steel. It should be understood that any other suitable materials could also be used. In one embodiment, the circular plate 140 has a centrally-located circular bore 142 that may be formed from by drilling, cutting, or any other suitable operation. Typically, the circular bore 142 is concentric with the circular plate 140.

The circular plate 140 is slidably disposed between the upper and lower paddle arms 120,130 and the back plate 150. Referring back to FIG. 1, the drive tube 200 passes through, and is substantially coaxial with, the circular bore 142 and in communication therewith. In particular, the diameter of the circular bore 142 and an outer diameter of the drive tube 200 are circumferentially engaged. That is, movement within the range of positions of the drive tube 200 typically results in uninhibited movement in the circular plate 140. In one embodiment, the diameter of the circular bore 142 is only slightly larger than the outer diameter of the drive tube 200 in order to prevent entry of debris or the like into the interior of the arm of the recliner chair.

In an exemplary embodiment, the outer diameter of circular plate 140 is slightly greater than any internal distance across the external aperture 114. In this embodiment, if the position of the drive arm 200 is moved upward from a central position within the external aperture 114, the circular plate would no longer substantially overlie the external aperture 114. However, the circular plate 140 will reach downward to the lower paddle arm 130 that is overlying a lower area of the external aperture 114. As such, the configuration of the plates 120,130,140, although each compactly-shaped, enables coverage of the external aperture 114 over the entire range of positions of the drive tube 200. This allows substantial coverage of the aperture within the current boundaries of the arm.

Although the circular plate 140 is depicted as having a generally circular configuration, it should be understood and appreciated by those of ordinary skill in the art that other configurations could be used, and that the invention is not limited to the circular shape shown and described. Further, the circular bore 142 is depicted as having a generally circular configuration; however, it should be understood and appreciated by those of ordinary skill in the art that other configurations—along with the fabrication operations required to achieve those configurations—could be used, and that the invention is not limited to the bored circular shape shown and described.

Figure 5:
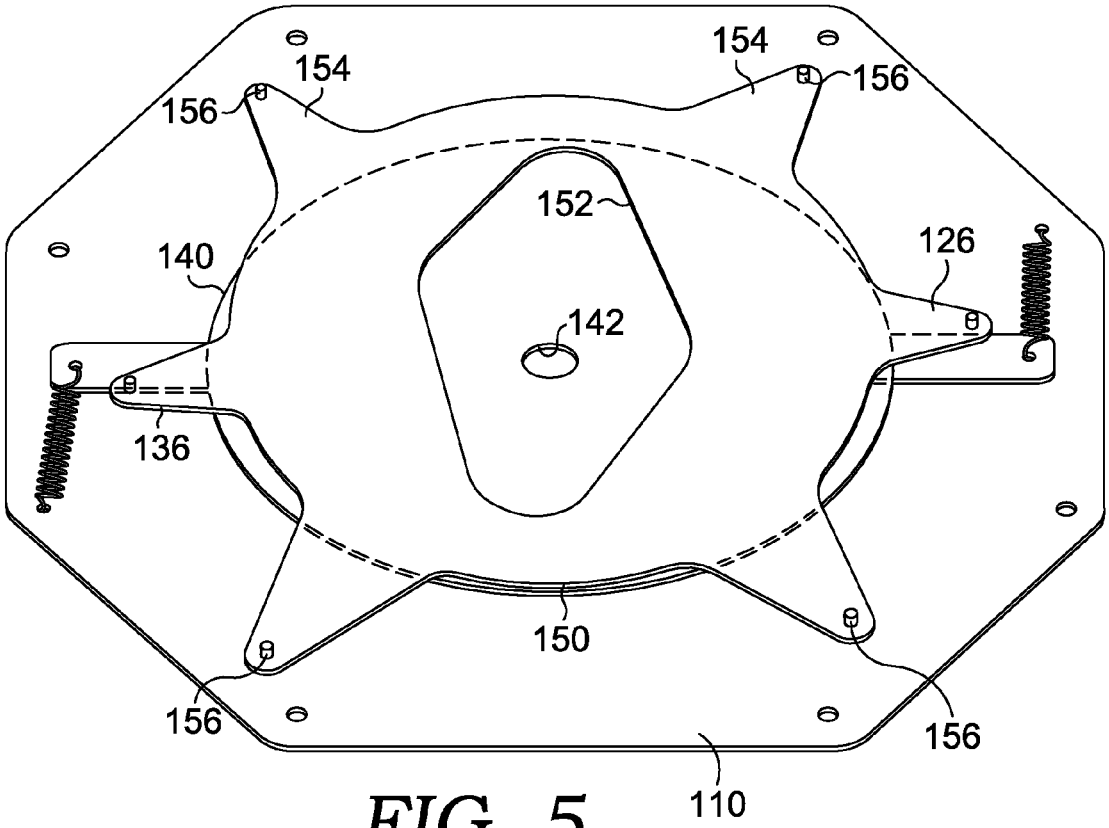
FIG. 5 is a view similar to FIG. 4, but with a back plate assembled thereto, in accordance with an embodiment of the present invention.

The back plate 150 is discussed herein with reference to FIG. 5. Back plate 150 is typically formed of sturdy material, such as stamped formed steel; however, it should be understood that any other suitable materials could also be used. The back plate 150 is fixedly attached to the cover plate 110 with fasteners 156 and pins 126,136, which are assembled to the connecting apertures 119 of the cover plate 110. Mounting extensions 154 extend from the back plate 150 and diverge radially therefrom so as to overlie the connecting apertures 119. In this embodiment, each mounting extension 154 includes an aperture (not shown) for connecting to the fasteners 156, and pins 126,136. Although, as discussed above, the movement of the circular plate 140 is typically governed by the drive arm 200, the fasteners 156 and pins 126,136 may function to establish limits on the movement of the circular plate 140. Although two configurations of the attachment are depicted, the connection between the cover plate 110 and the back plate 150 may be by hex-bolts, hex-nuts, or any other suitable fasteners which are well known in the furniture manufacturing industry.

The back plate 150 includes an internal aperture 152 that may be formed by stamping, cutting, or any other suitable fabrication processes. In one embodiment, the internal aperture 152 is centrally located within the back plate 150 and is shaped to provide clearance for the entire range of positions of the drive tube 200, as discussed in detail below with reference to FIG. 6. By way of example, the internal aperture 152 may have an aperture profile that is generally diamond-shaped. In this example, the aperture profile of the internal aperture 152 may reside in substantially parallel-spaced relation with the aperture profile of the external aperture profile 114 (discussed above with reference to FIG. 2).

Figure 6:
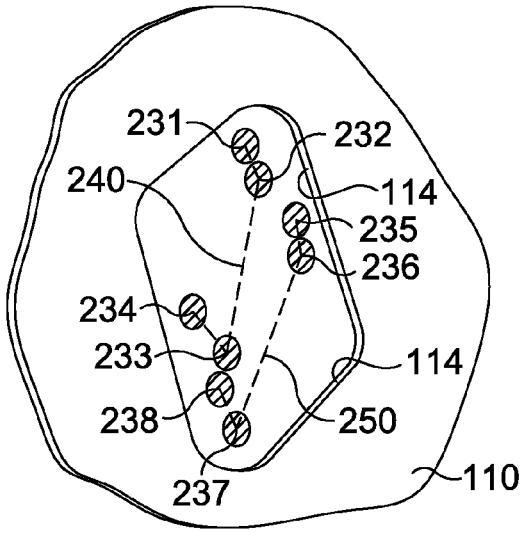
FIG. 6 is an internal perspective view of a portion of the cover plate showing various exemplary positions of a cross-sectioned drive tube within an external aperture of the cover plate, in accordance with embodiments of the present invention.

Turning now to FIG. 6, an illustration depicting various exemplary positions of the drive tube 200 (FIG. 1) within the external aperture 114 of the cover plate 110—as observed from an outward perspective—is shown. In one embodiment of the present invention, the illustration in FIG. 6 of the positions of the drive tube 200 (FIG. 1) correspond to the positions of the drive tube 200 within the internal aperture 152 (FIG. 5) as well. The details of the recliner positions that correspond to the positions of the drive tube 200 are set forth in pages 13-16, paragraphs [0043]-[0048], of U.S. patent application Ser. No. 11/412,679, filed Apr. 27, 2006, entitled SLEEP OVER RECLINER CHAIR, the disclosure of which is herein incorporated by reference. Consistent with this exemplary recliner chair, the positions of the drive tube 200 correspond to the following recliner positions: footrest closed, back fully reclined, 231,235; footrest extended, back fully reclined, 232,235; footrest extended, back upright, 237, 233; and footrest closed, back upright, 238,234. Further those positions with a Trendelenberg engaged are connected by travel-path line 240, while those without the Trendelenberg engaged are connected by travel-path line 250. In one embodiment, the generally diamond-shaped aperture profile of the external aperture 114 is specifically shaped to encompass the range of positions of the drive tube 200.

The operation of the shielding assembly with the recliner mechanism is best described with reference to FIGS. 7-9. Initially, the drive tube 200 moves to positions that correspond with the recliner positions of the recliner mechanism, as discussed in detail above. Further, the drive tube 200 may move the plates 120,130,140 as it is shifted from one position to another, as directed by the recliner mechanism that is pivotably coupled thereto.

Figure 7:
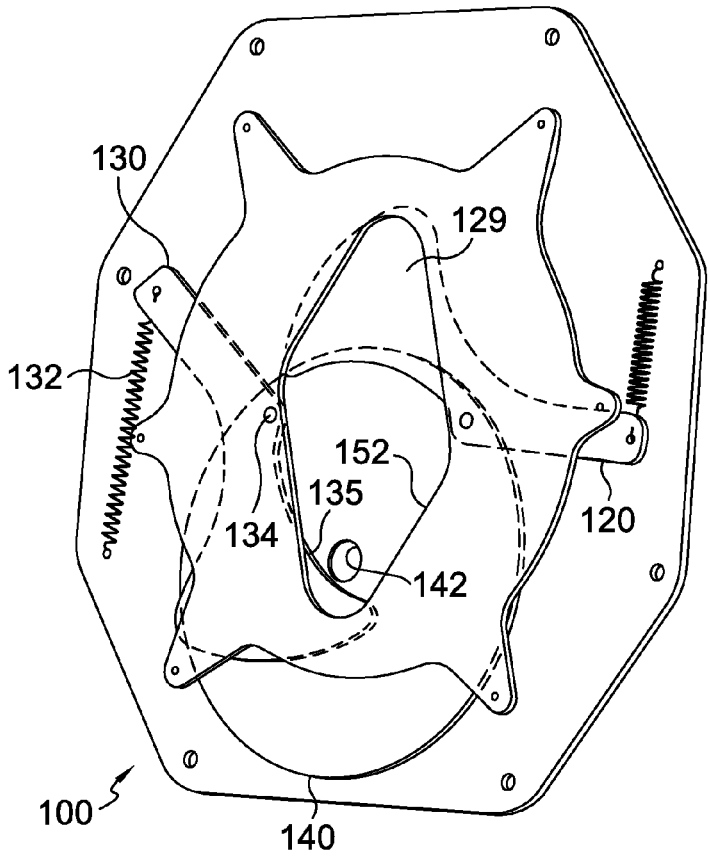
FIG. 7 is an diagrammatic internal perspective view of the shield assembly in a footrest extended, backrest upright position, the shield assembly positioned according to an embodiment of the present invention.

The following discussion is with reference to the footrest extended, back upright, Trendelenberg disengaged position 237 (FIG. 6) illustrated in FIG. 7, also depicted in FIG. 1. If the drive tube 200 moves to a downward position, then the circular plate 140, which is circumferentially engaged to the drive tube 200, is moved downward such that it no longer substantially overlies an upper portion the internal aperture 152. As the outside circumference of the drive tube 200 contacts the arcuate communication edge 135 it rotates the lower paddle arm 130 about the pivot 134 to a deflected position. Although the surface of the circular plate 140 no longer substantially overlies the internal aperture 152, the coverage portion 129 of the upper paddle arm 120, which remains in coverage position, overlies the upper portion of the internal aperture 152 vacated by the circular plate 140. As such, the combination of the circular plate 140 and the upper paddle arm 120 provides substantial coverage of the internal aperture 152 when in position 237 of the drive tube 200.

Figure 8:
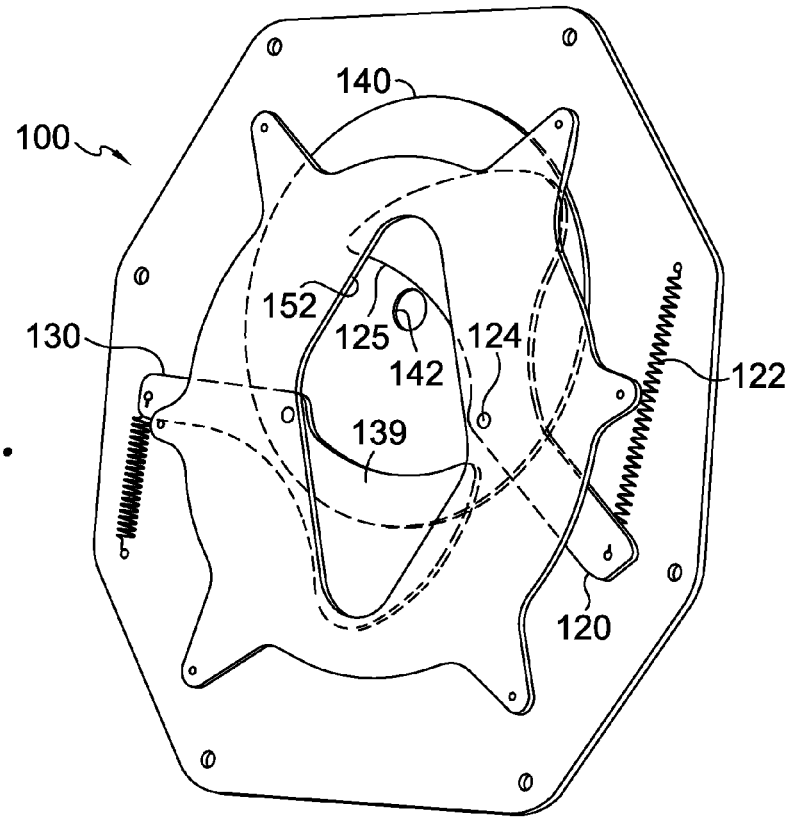
FIG. 8 is a view similar to FIG. 7, but with the shield assembly in a footrest closed, back fully reclined, Trendelenberg engaged position, the shield assembly positioned according to an embodiment of the present invention.

The footrest closed, back fully reclined, Trendelenberg engaged position 231 is depicted in FIG. 8. If the drive tube 200 moves to an upward position, then the circular plate 140 moves upward such that its surface no longer substantially overlies a lower portion of the internal aperture 152. As the outside circumference of the drive tube 200 contacts the arcuate communication edge 125 it rotates the upper paddle arm 120 about the pivot 124 to a deflected position. Although the surface of the circular plate 140 no longer substantially overlies the internal aperture 152, the coverage portion 139 of the lower paddle arm 130, which remains in coverage position, overlies the lower portion of the internal aperture 152 vacated by the circular plate 140. As such, the combination of the circular plate 140 and the lower paddle arm 130 provides substantial coverage of the internal aperture 152 when in position 231 of the drive tube 200.

The advantage, as indicated in FIGS. 7 and 8, is that the circular plate 140 may be compactly-shaped. This is because coverage is provided by the combination of the plates 120, 130,140 and not the circular plate 140 alone. As such, the total size of the shielding assembly 100 may be reduced, i.e., requiring less space within an interior of the arm of the chair.

Figure 9:
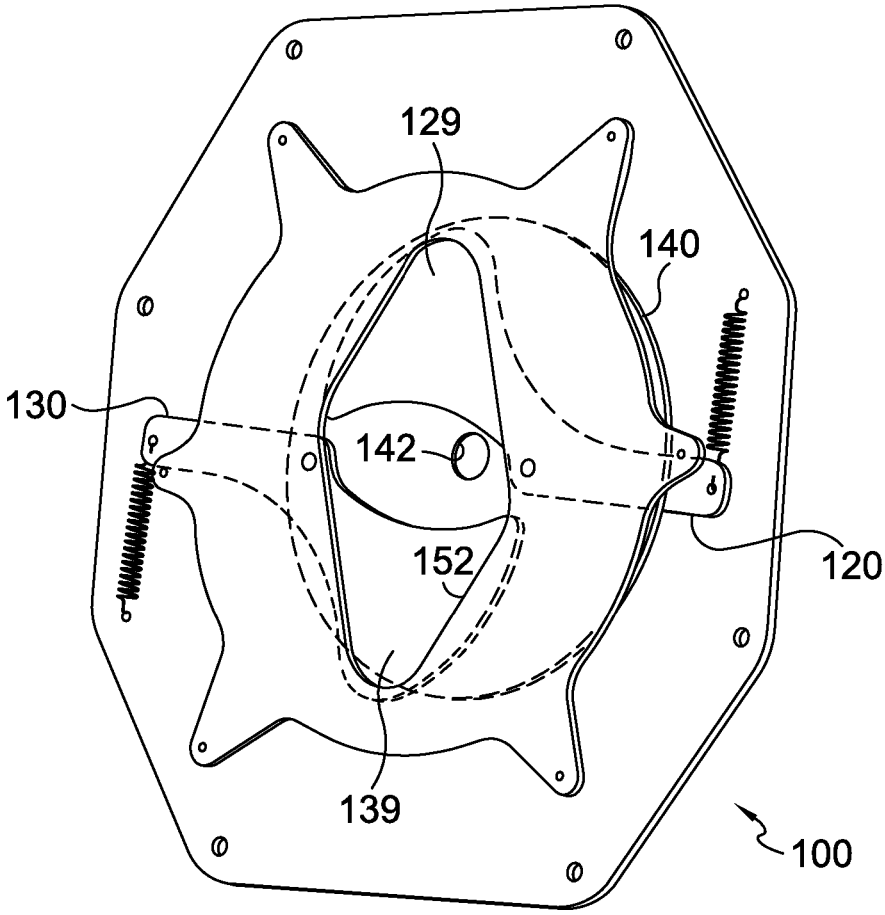
FIG. 9 is a view similar to FIG. 7, but with the shield assembly in a footrest extended, back fully reclined position, the shield assembly positioned according to an embodiment of the present invention.

The footrest extended, back fully reclined, Trendelenberg disengaged position 236 is depicted in FIG. 9. If the drive tube 200 moves laterally but neither upward nor downward, then the circular plate 140 is traversed laterally such that its surface continues to substantially overlie the internal aperture 152. The upper and lower paddle arms 120, 130, remain in their respective coverage positions. That is, neither the upper nor lower paddle arm 120,130 are rotated to a deflected position; as such, the combination of each of the plates 120,130,140, or simply the circular plate 140 alone, provides substantial coverage of the internal aperture 152 when in position 236 of the drive tube 200.

It should be understood that the construction of the shielding mechanism 100 lends itself to be easily assembled and disassembled from the recliner chair. Specifically the nature of the mounting holes 118 on the cover plate 110 allow the shielding assembly to be easily removed as a unit and individually shipped. While much of the discussion above focused on a specific embodiment of a sleep over recliner chair, the invention is applicable to any chair having a mechanism that has a drive tube that moves with respect to an arm, where the arm has an opening that can be covered.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A shield assembly for a recliner chair having at least one arm and a recliner mechanism, the recliner mechanism having a drive component protruding through the arm, the drive component moveable with respect to the arm, the shield assembly comprising:

a cover plate coupled to the arm, the cover plate having an external aperture through which the drive component extends, the external aperture sized to accommodate movement of the drive component;

a back plate, fixedly attached to the cover plate, having an internal aperture through which the drive component extends, the internal aperture sized to accommodate movement of the drive component;

an upper paddle arm rotatably coupled to the cover plate between the cover plate and back plate, and partially covering an upper portion of the external and internal apertures;

a lower paddle arm rotatably coupled to the cover plate between the cover plate and back plate, and partially covering a lower portion of the external and internal apertures;

a circular plate having a bore sized to correspond to the drive component and through which the drive component extends, the circular plate slidably disposed between the back plate and the cover plate and positioned to at least partially cover a central portion of the external and internal apertures;

wherein the paddle arms and the circular plate cooperate to cover the internal aperture and external the aperture.

2. The shield assembly of claim 1, further comprising one or more fasteners that fixedly attached the cover plate to the back plate, the one or more fasteners restricting rotation of the upper and lower paddle arms.

3. The shield assembly of claim 2, wherein the one or more fasteners limit movement of the slidably disposed circular plate.

4. The shield assembly of claim 1, wherein the upper and lower paddle arms rotate independently of one another.

5. The shield assembly of claim 4, further comprising a tension device coupled to the upper paddle arm that exerts a biasing force on the upper paddle arm to substantially cover the upper portion of the external and internal apertures, and a lower tension device coupled to the lower paddle arm that exerts a biasing force on the lower paddle arm to substantially cover the lower portion of the external and internal apertures.

6. The shield assembly of claim 5, wherein the internal aperture and external aperture have aperture profiles in substantial parallel-spaced alignment.

7. The shield assembly of claim 5, wherein movement of the drive component to an upper portion of the external and internal apertures operates to move the circular plate to a position covering the upper portion of the external and internal apertures as the upper paddle arm is rotated away from covering the apertures by contact from the drive component, and wherein the lower paddle arm continues to cover a lower portion of the external and internal apertures.

8. The shield assembly of claim 7, wherein movement of the drive component from the upper portion of the external and internal apertures to a central portion of the apertures operates to move the central plate to a position covering the central portion of the apertures, and wherein the tension device coupled to the upper paddle arm rotates the upper paddle arm so that it returns to a position covering the upper portion of the external and internal apertures.

9. The shield assembly of claim 5, wherein movement of the drive component to a lower portion of the external and internal apertures operates to move the circular plate to a position covering the lower portion of the external and internal apertures as the lower paddle arm is rotated away from covering the apertures by contact from the drive component and wherein the upper paddle arm continues to cover an upper portion of the external and internal apertures.

10. The shield assembly of claim 9, wherein movement of the drive component from the lower portion of the external and internal apertures to a central portion of the apertures operates to move the central plate to a position covering the central portion of the apertures, and wherein the tension device coupled to the lower paddle arm rotates the lower paddle arm so that it returns to a position covering the lower portion of the external and internal apertures.

11. The shield assembly of claim 10, wherein the upper and lower paddle arms each have an arcuate edge facing the drive component to facilitate rotation of the respective paddle arm as the drive component contacts the paddle arm.

12. A recliner chair having at least one arm, the recliner chair comprising:

a recliner mechanism having a drive component that protrudes through the arm, the drive component moveable with respect to the arm; and a shielding assembly adapted to mount to the arm, the shielding assembly comprising a cover plate coupled to the arm, the cover plate having an external aperture through which the drive component extends, the external aperture sized to accommodate movement of the drive component, a back plate, fixedly attached to the cover plate, having an internal aperture through which the drive component extends, the internal aperture sized to accommodate movement of the drive component, an upper paddle arm rotatably coupled to the cover plate between the cover plate and back plate, and partially covering an upper portion of the external and internal apertures, a lower paddle arm rotatably coupled to the cover plate between the cover plate and back plate, and partially covering a lower portion of the external and internal apertures, a circular plate having a bore sized to correspond to the drive component and through which the drive component extends, the circular plate slidably disposed between the back plate and the cover plate and positioned to at least partially cover a central portion of the external and internal apertures;

wherein the paddle arms and the circular plate cooperate to cover the internal aperture and external the aperture.

13. The recliner chair of claim 12, further comprising one or more fasteners that fixedly attached the cover plate to the back plate, the one or more fasteners restricting rotation of the upper and lower paddle arms.

14. The recliner claim of claim 13, wherein the one or more fasteners limit movement of the slidably disposed circular plate.

15. The recliner chair of claim 12, wherein the upper and lower paddle arms rotate independently of one another.

16. The recliner chair of claim 15, further comprising a tension device coupled to the upper paddle arm that exerts a biasing force on the upper paddle arm to substantially cover the upper portion of the external and internal apertures, and a lower tension device coupled to the lower paddle arm that exerts a biasing force on the lower paddle arm to substantially cover the lower portion of the external and internal apertures.

17. The recliner chair of claim 16, wherein the internal aperture and external aperture have aperture profiles in substantial parallel-spaced alignment.

18. The recliner chair of claim 16, further comprising:

the external aperture having an upper portion, a central portion, and a lower portion; and the internal aperture having an upper portion, a central portion, and a lower portion;

wherein movement of the drive component to the upper portion of the external and internal apertures operates to move the circular plate to a position covering the upper portion of the external and internal apertures as the upper paddle arm is rotated away from covering the apertures by contact from the drive component, and wherein the lower paddle arm continues to cover the lower portion of the external and internal apertures; and wherein movement of the drive component from the upper portion of the external and internal apertures to the central portion of the apertures operates to move the central plate to a position covering the central portion of the apertures, and wherein the tension device coupled to the upper paddle arm exerts a biasing force such that the upper paddle arm returns to a position covering the upper portion of the external and internal apertures.

19. The recliner chair of claim 16, further comprising:

the external aperture having an upper portion, a central portion, and a lower portion; and the internal aperture having an upper portion, a central portion, and a lower portion;

wherein movement of the drive component to the lower portion of the external and internal apertures operates to move the circular plate to a position covering the lower portion of the external and internal apertures as the lower paddle arm is rotated away from covering the apertures by contact from the drive component and wherein the upper paddle arm continues to cover the upper portion of the external and internal apertures; and wherein movement of the drive component from the lower portion of the external and internal apertures to the central portion of the apertures operates to move the central plate to a position covering the central portion of the apertures, and wherein the tension device coupled to the lower paddle arm rotates the lower paddle arm so that it returns to a position covering the lower portion of the external and internal apertures.

20. The recliner chair of claim 12, wherein the upper and lower paddle arms each have an arcuate edge facing the drive component to facilitate rotation of the respective paddle arm as the drive component contacts the paddle arm.

* * * * *